US007938651B2

(12) United States Patent
Hanyu et al.

(10) Patent No.: US 7,938,651 B2
(45) Date of Patent: May 10, 2011

(54) SUBSTRATE CONNECTOR

(75) Inventors: Takuji Hanyu, Tokyo (JP); Yuji Hori, Kyoto (JP)

(73) Assignees: Molex Incorporated, Lisle, IL (US); Nintendo Co., Ltd., Kyoto (JP)

( * ) Notice: Subject to any disclaimer, the term of this patent is extended or adjusted under 35 U.S.C. 154(b) by 11 days.

(21) Appl. No.: 12/513,179

(22) PCT Filed: Nov. 2, 2007

(86) PCT No.: PCT/US2007/023153

§ 371 (c)(1),
(2), (4) Date: Oct. 19, 2009

(87) PCT Pub. No.: WO2008/057424

PCT Pub. Date: May 15, 2008

(65) Prior Publication Data

US 2010/0041255 A1 Feb. 18, 2010

(30) Foreign Application Priority Data

Nov. 2, 2006 (JP) ..... 2006-298729

(51) Int. Cl.
*H01R 12/00* (2006.01)

(52) U.S. Cl. ..... 439/79; 439/541.5

(58) Field of Classification Search ..... 439/79, 439/80, 140, 141, 375, 892, 541.5
See application file for complete search history.

(56) References Cited

U.S. PATENT DOCUMENTS

| | | | | |
|---|---|---|---|---|
| 5,080,596 | A | 1/1992 | Viselli et al. | |
| 5,591,036 | A * | 1/1997 | Doi et al. | 439/79 |
| 6,171,116 | B1 * | 1/2001 | Wicks et al. | 439/79 |
| 6,443,742 | B2 * | 9/2002 | Ishikawa | 439/79 |
| 6,494,724 | B1 * | 12/2002 | Bixler et al. | 439/79 |
| 6,866,552 | B2 * | 3/2005 | Koehler | 439/892 |
| 7,048,553 | B2 * | 5/2006 | Osada | 439/79 |

FOREIGN PATENT DOCUMENTS

| | | |
|---|---|---|
| JP | 04-269473 | 9/1992 |
| JP | 2006-147372 | 6/2006 |
| WO | PCT/US2002/010286 | 10/2002 |

OTHER PUBLICATIONS

International Search Report and Written Opinion of PCT/US2007/0023153. Apr. 17, 2008.

* cited by examiner

*Primary Examiner* — Neil Abrams
*Assistant Examiner* — Phuong T Nguyen
(74) *Attorney, Agent, or Firm* — Timothy M. Morella

(57) ABSTRACT

A substrate connector includes a housing (11), a plurality of terminals (51, 52, 53, 54) which project from the housing and are connected to a substrate, and a guide plate (41) which is secured to the housing for guiding at least some of the terminals. The guide plate includes a main part formed in a meandering shape, and end portions which are joined to opposite sides of the main part and are attached to guide plate attaching portions arranged on opposite sides of the housing.

8 Claims, 18 Drawing Sheets

SUBSTRATE CONNECTOR

BACKGROUND OF THE INVENTION

The present invention relates to a connector for a substrate (hereinafter referred to as a substrate connector throughout this application).

A substrate connector has conventionally been used for being mounted on a substrate of a printed circuit board and the like to be connected to other electric circuits and the like. Such a substrate connector is provided with a plurality of L-shaped terminals projecting backward of a main body of the connector and a guide plate for use in guiding the terminals (see, for example, Japanese Patent Application Laid-Open (Kokai) No. 2006-147372).

FIG. 18 is an exploded view of a conventional substrate connector.

As shown in the FIG. 18, the substrate connector has a first terminal assembly 801 and a second terminal assembly 802 which are made of a conductive material such as a metal; and a terminal holding member 803 made of an insulating material such as a synthetic resin for supporting the first terminal assembly 801 and the second terminal assembly 802. Further, a plurality of terminals of the first terminal assembly 801 and a plurality of terminals of the second terminal assembly 802 are attached to the terminal holding member 803 in a state where the terminals are arranged in parallel with each other. In addition, the periphery of the terminal holding member 803 having the first terminal assembly 801 and the second terminal assembly 802 attached thereto is covered with a connector housing (not illustrated) formed in a box-like shape. Further, the substrate connector is a so-called receptacle connector and a mating connector connected to a front end of a cable (not illustrated) is fitted to be plugged into the substrate connector.

In addition, each of the first terminal assembly 801 and the second terminal assembly 802 has L-shaped terminals, which project backward, respectively, from the terminal holding member 803 and is entirely bent approximately at a right angle, so that a front end thereof is directed downward. Further, the lowermost end of the downward portion of each terminal assembly 801 and 802 is mounted on a surface of a substrate (not illustrated), so that each of the first terminal assembly 801 and the second terminal assembly 802 is bent in parallel to the surface of the substrate to be formed in a solder tail portion. Then, the solder tail portion is mounted on and connected to a connection pad which is formed on the surface of the substrate by soldering.

The terminal holding member 803 has an attaching portion 804 and a plate-like extending portion 805 which is formed to extend forward from this attaching portion 804, so that respective horizontal portions of the first terminal assembly 801 and the second terminal assembly 802 are attached to be laid along the lower surface and the upper surface of the extending portion 805. Then, a plurality of first terminal insertion ports 811 into which the horizontal portion of the first terminal assembly 801 is inserted and a plurality of second terminal insertion ports 812 into which the horizontal portion of the second terminal assembly 802 is inserted are formed in the attaching portion 804 in parallel with each other.

Upon attachment to the attaching portion 804, the horizontal portion of the first terminal assembly 801 is located on the lower side of the horizontal portion of the second terminal assembly 802 and a vertical portion of the first terminal assembly 801 is positioned in front of the vertical portion of the second terminal assembly 802. Therefore, the vertical portion of the second terminal assembly 802 is formed so as to be longer than the vertical portion of the first terminal assembly 801, so that the vertical portion of the second terminal assembly 802 is easily displaced by the influence of any external force such as vibration and a thermal stress. Therefore, in order to prevent the displacement of the vertical portion of the second terminal assembly 802, a guide plate 815 is secured to the attaching portion 804.

The guide plate 815 is a plate-like member provided with a plurality of positioning grooves 816 into which the vertical portions of respective terminals of the second terminal assembly 802 are inserted and the guide plate 815 has the laterally opposite ends so as to be locked in a first guide groove 817 and a second guide groove 818 which are formed in the attaching portion 814. Hence, displacement of the vertical portion of the second terminal assembly 802 is surely and reliably prevented and the vertical portions of the adjacent terminals of the second terminal assembly 802 do not come in contact with each other and the tail portion attached to the connection pad by soldering is not separated apart from the connection pad due to a force applied to the tail portion.

However, with the conventional substrate connector, there is difficulty in mounting the guide plate 815 on the attaching portion 804, and therefore, its workability is rather low. Additionally, when mounting the guide plate 815 on the attaching portion 804, a portion of a complimentary member might be partially damaged or broken and/or the guide plate 815 might fail to be surely mounted on the attaching portion 804, so that play in the guide plate 815 might occur and may be eventually separate from the attaching portion 804.

Taking the above situation into consideration, for example, in order to lock the lateral opposite ends of the guide plate 815, it may be contemplated that a protrusion for locking is formed within the first guide groove 817 and the second guide groove 818. In this case, when an amount of projection of the protrusion for locking is determined to be large in order to certainly lock the guide plate 815, it is necessary to give a large amount of force when inserting the lateral opposite ends of the guide plate 815 in the first guide groove 817 and the second guide groove 818, so that its workability becomes low. In addition, applying a large amount of force and inserting the lateral opposite ends of the guide plate 815 in the first guide groove 817 and the second guide groove 818, the protrusion for locking and a certain member of the lateral opposite ends of the guide plate 815 may be worn or damaged. Further, if there is a large error in the length between the lateral opposite ends of the guide plate 815 and in the depth of each or both of the first guide groove 817 and the second guide groove 818, it becomes necessary to apply a large amount of force when mounting the guide plate 815 on the attaching portion 804 or play in the guide plate 815 which is mounted on the attaching portion 804 might occur, or the guide plate 815 might be dismounted and separated apart from the attaching portion 804.

SUMMARY OF THE INVENTION

The present invention has been made to solve the foregoing problems of the above-described conventional substrate connector, and has an object to provide a substrate connector capable of surely and reliably functioning to guide terminals, in which the opposite ends of the guide plate may be easily inserted in recessed portions formed in the opposite ends of the housing upon mounting the guide plate in a housing by providing a main body of the guide plate with a generally meandering shape when viewing the body in a longitudinal direction thereof (hereinafter referred to as "a meandering shape" in this application) thereby allowing the guide plate to elastically displace a positional relation between the opposite ends of the guide plate; the protrusions for locking for locking which are formed on the opposite ends of the guide plate or the recessed portion are not damaged; even if an accuracy of the size and dimension of the member is low, no play of the guide plate occurs mounted in the housing due to elasticity provided to the main body of the guide plate and the guide plate is not dismounted and removed.

Therefore, an objective of this present invention is to provide a substrate connector with a housing, a plurality of terminals which project from the housing and are connected to a substrate, and a guide plate or tail aligner, which is attached to the housing for guiding at least some of terminals, wherein the guide plate comprises a main part having a meandering shape, and end portions which are joined to opposite sides of the main part and are attached to guide-plate attaching portions, which are arranged on opposite sides of the housing.

Another objective of the present invention is to provide a substrate connector with each of the terminals comprising a main part which is mounted on the housing, a contact portion which is connected to a front end of the main part and is intended to be in contact with a mating terminal; and a leg portion which is connected to a rear end of the main part at a bent end thereof and has a lower end thereof to be connected to a substrate; and the guide plate has guide grooves for holding the leg portions of at least some of the terminals, respectively.

A further objective of the present invention is to provide a substrate connector with each of the guide grooves having a bottom portion in which the terminal is held, and the bottom portion being located at such a position where, when the terminal is mounted on the housing without attaching of the guide plate to the housing, the position of the bottom portion is located backward of a position of the leg portion.

A still further objective of the present invention is to provide a substrate connector with each of the guide plates attaching portions of the housing comprises an insertion groove and a projection for locking; and each of the ends of the guide plate comprises an external edge to be inserted into the insertion groove and a locked portion which projects outward from the end to be locked by the projection for locking.

A still further objective of the present invention is to provide a substrate connector when attaching the guide plate in the housing, a top portion of the locked portion is urged to move while riding a top portion of the projection for locking.

A still further objective of the present invention is to provide a substrate connector where a distance between the external edges on the opposite sides of the guide plate is determined to be longer than a distance between bottom surfaces of the insertion grooves of the guide plate attaching portions on the opposite sides of the housing.

A still further objective of the present invention is to provide a substrate connector with the main part of the guide plate comprises front side convex portions and front side concave portions which are alternately aligned on a front face of the main part and rear side convex portions and rear side concave portions which are alternately aligned on a rear face of the main part; and the respective front side convex portions and the respective rear side concave portion are arranged to be in registration with each other and the front side concave portions and the rear side convex portions are arranged to be in registration with each other.

A still further objective of the present invention is to provide a substrate connector where the terminals include first terminals and second terminals which are juxtaposed with each other in a meandering shape in a width direction of the substrate connector; and the guide grooves of the guide plate include first guide grooves for holding first leg portions of the respective first terminals from behind and second guide grooves for holding second leg portions of the second terminals from behind.

In accordance with the present invention, in a substrate connector, since the main body of the guide plate is formed in a meandering shape, a positional relationship between the opposite ends of the guide plate can be elastically displaced. Therefore, upon mounting the guide plate in the housing, the opposite ends of the guide plate can be easily inserted into recessed portions formed in the opposite ends of the housing. Additionally, the projections for locking which are formed in either the opposite ends of the guide plate or the recessed portions of the housing are not damaged. Further, even if the size and dimension of the respective structural members of the substrate connector are kept less accurate, any play does not occur in the mounted guide plate due to elasticity provided to the main body of the guide plate and accordingly, the guide plate is not dismounted and separated apart from the housing, so that the guide plate may be able to surely guide the terminals.

DESCRIPTION OF THE PREFERRED EMBODIMENTS

Preferred embodiments of the present invention will be described hereinbelow in detail with reference to the accompanying drawings.

Figure 1:
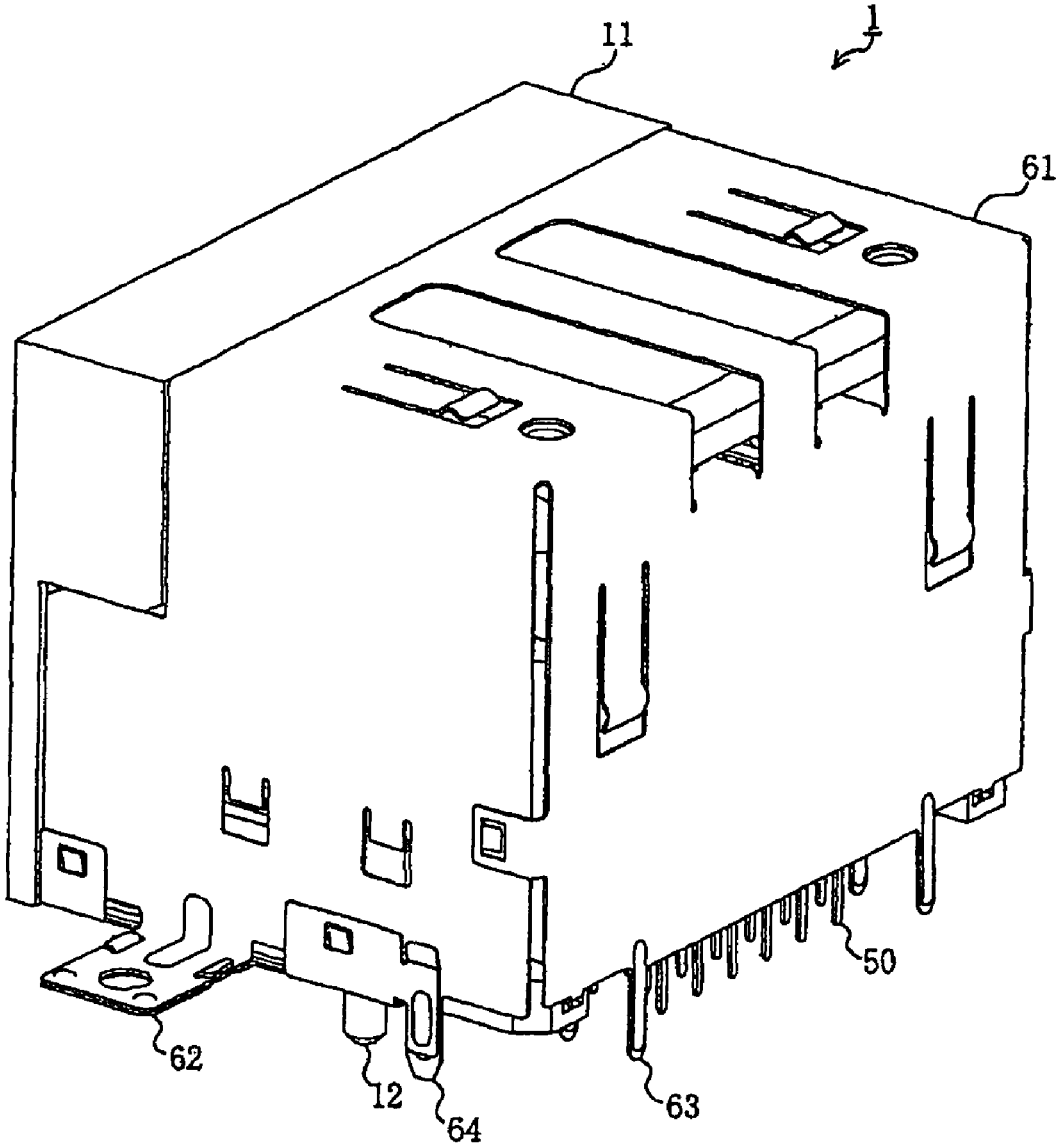
FIG. 1 is a perspective view illustrating a rear side of a connector according to an embodiment of the present invention.
Figure 2:
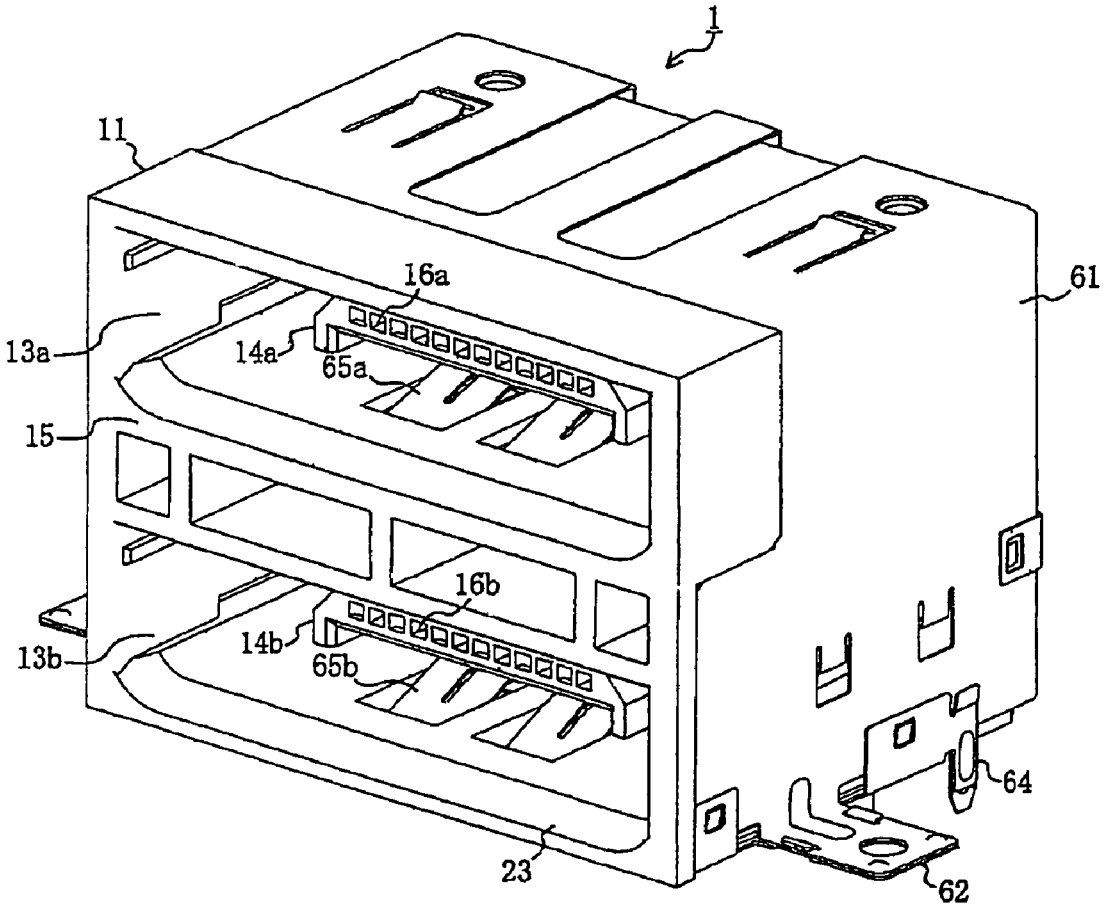
FIG. 2 is a perspective view illustrating a front side of the connector according to the embodiment of the present invention.
Figure 3:
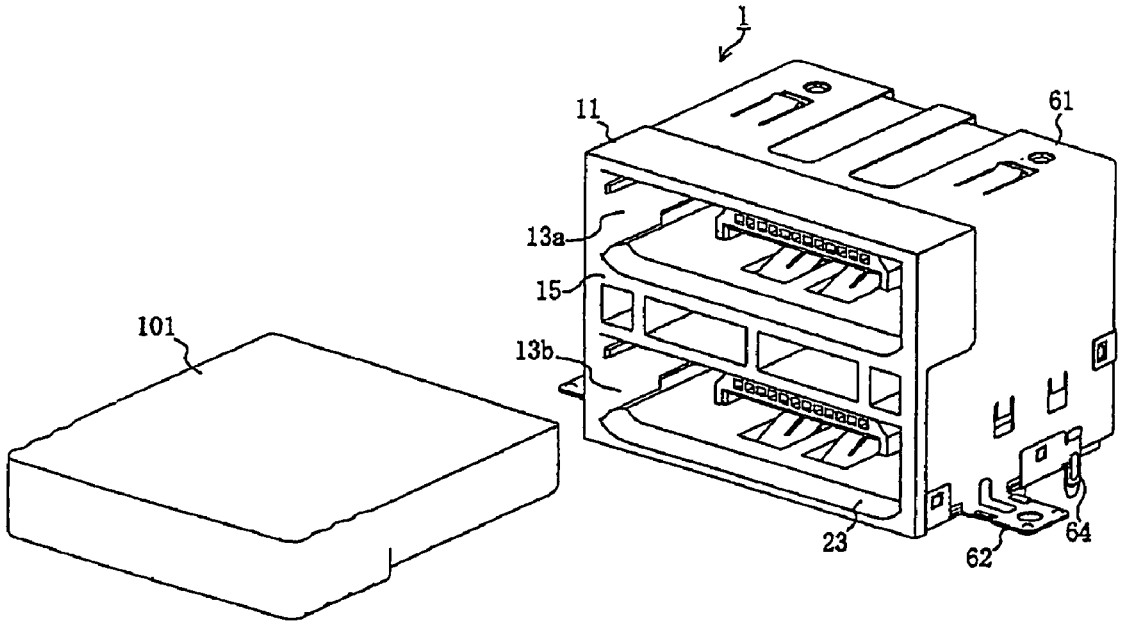
FIG. 3 is a perspective view illustrating a relationship between the substrate connector and a card, according to the embodiment of the present invention.

FIG. 1 is a perspective view illustrating a rear side of a substrate connector according to an embodiment of the present invention, FIG. 2 is a perspective view illustrating a front side of the substrate connector according to the embodiment of the present invention, and FIG. 3 is a perspective view illustrating a relationship between the substrate connector and a card, according to the embodiment of the present invention.

In the drawing figures, a reference numeral 1 denotes a connector provided as a substrate connector according to an embodiment of the present invention (hereinbelow, referred to as "connector 1" for simplicity sake), which is mounted on a substrate such as a printed circuit used for electric equipment and apparatuses and the like (not illustrated). Then, a card 101 is inserted in an upper insertion opening 13*a* and a lower insertion opening 13*b* of the connector 1, and via the connector 1, the card 101 is loaded on the electric equipment. For example, the electric equipment may be a personal computer, a cell or mobile phone handset, a PDA, a digital camera, a video camera, an audio player, a game machine, and a vehicular navigation system and the like, however, the electric equipment may be any kind of electric or electronic apparatus or device.

Additionally, the connector 1 is not always limited to a connector for allowing insertion of the card 101 therein, for example, the connector 1 may be a connector for allowing a mating connector which is connected to a terminal end of a cable including a core wire having a circular section to be fitted therein or it may be a connector for allowing connection therein of a plate-like flexible cable such as a flexible flat cable (FFC) and a flexible printed circuit (FPC). Here, the explanation will be provided based on such an assumption that the connector 1 is a connector for inserting the card 101 therein.

Additionally, in this embodiment, representations of directions such as up, down, left, right, front, rear, and the like that are used for explaining the structure and movement of each part of the connector 1, and the like, are not absolute, but relative. These representations are appropriate when the connector 1 or its constituent part is in the position shown in the figures. If the posture of the connector 1 or its constituent part changes, however, it is assumed that these representations are to be changed according to the change of the position of the connector 1 or its constituent part.

The connector 1 has a housing 11 in the form of an approximately rectangular box shape which is integrally formed by an insulating material such as a synthetic resin and terminals 50 made of a conductive material such as a metal which are attached to the housing 11. Further, the connector 1 is provided with a shell 61 made of a metallic plate which is attached so as to enclose the periphery of the housing 11. In the example shown in the drawing figures, the shell 61 encloses either all of the entire surfaces except for the front surface i.e., the surface through which the card 101 is inserted, or a part of the surfaces of the housing 11, the shell 61 may be connected to a grounding wire of the substrate via a mounting ear part 62, a first insertion projection 63, and a second insertion projection 64 so as to provide shielding to the connector 1. In FIG. 1, a reference numeral 12 denotes a projection for attaching a housing which projects from a bottom plate 23 of the housing 11.

Additionally, the interior part of the housing 11 is vertically divided by a division wall part 15, so that the upper insertion opening 13*a* and the lower insertion opening 13*b* are formed. Then, in the interior parts of the upper insertion opening 13*a* and the lower insertion opening 13*b*, an upper extension portion 14*a* and a lower extension portion 14*b* which are formed in a plate-like shape and are extended in an insertion direction of the card 101 are arranged, respectively. Further, in the upper extension portion 14*a* and the lower extension portion 14*b*, a plurality of upper terminal receipt holes 16*a* and lower terminal receipt holes 16*b* are formed, respectively, in order to receive terminals 50 therein. In addition, in the interior parts of the upper insertion opening 13*a* and the lower insertion opening 13*b*, have an upper tongue 65*a* and lower tongue 65*b* made of a metallic plate, respectively, are arranged, which are connected to the shell 61 and are able to come in contact with the respective lower surfaces of the inserted cards 101.

Further, the connector 1 is a so-called connector of a right angle type, and this connector 1 is mounted in a manner such that the insertion direction of the card 101 is in parallel with the substrate. Namely, the connector 1 is mounted so that the upper insertion opening 13*a* and the lower insertion opening 13*b* are opened toward a lateral direction, and that the lower ends of the respective terminals 50 and the first and second insertion projections 63 and 64 are all inserted perpendicularly to the substrate into holes such as through-holes formed in the substrate and are fixed by soldering.

Next, the structure for guiding or aligning, the terminals 50 attached to the housing 11 will be described.

Figure 4:
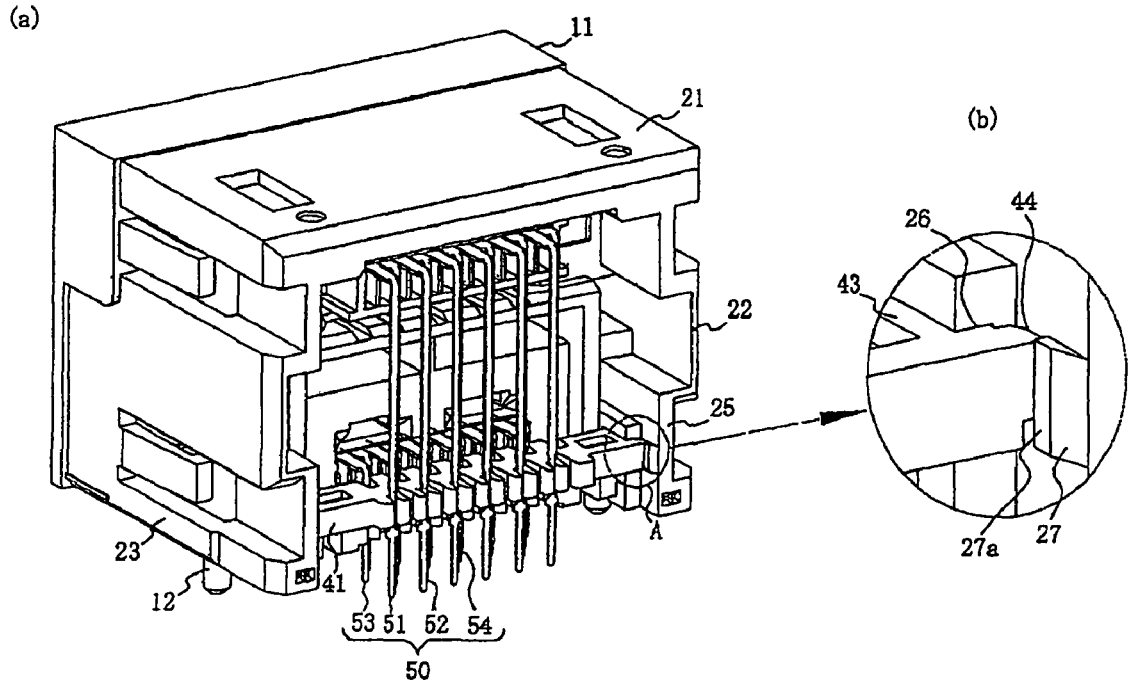
FIG. 4 is a perspective view illustrating the rear side of the substrate connector in a state that a shell of the connector is removed, according to the embodiment of the present invention.
Figure 5:
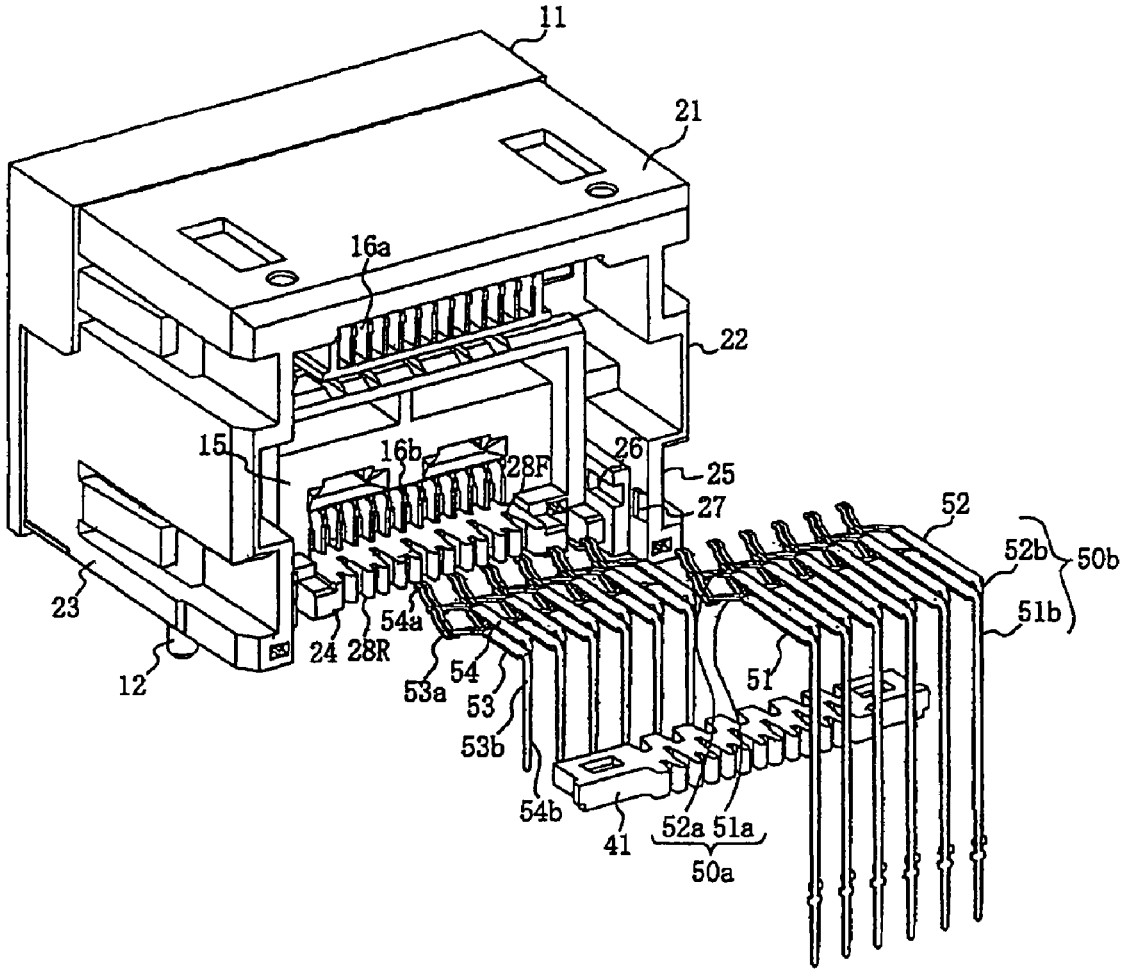
FIG. 5 is an exploded perspective view of terminals and a guide plate to be attached to the connector according to the embodiment of the present invention.
Figure 6:
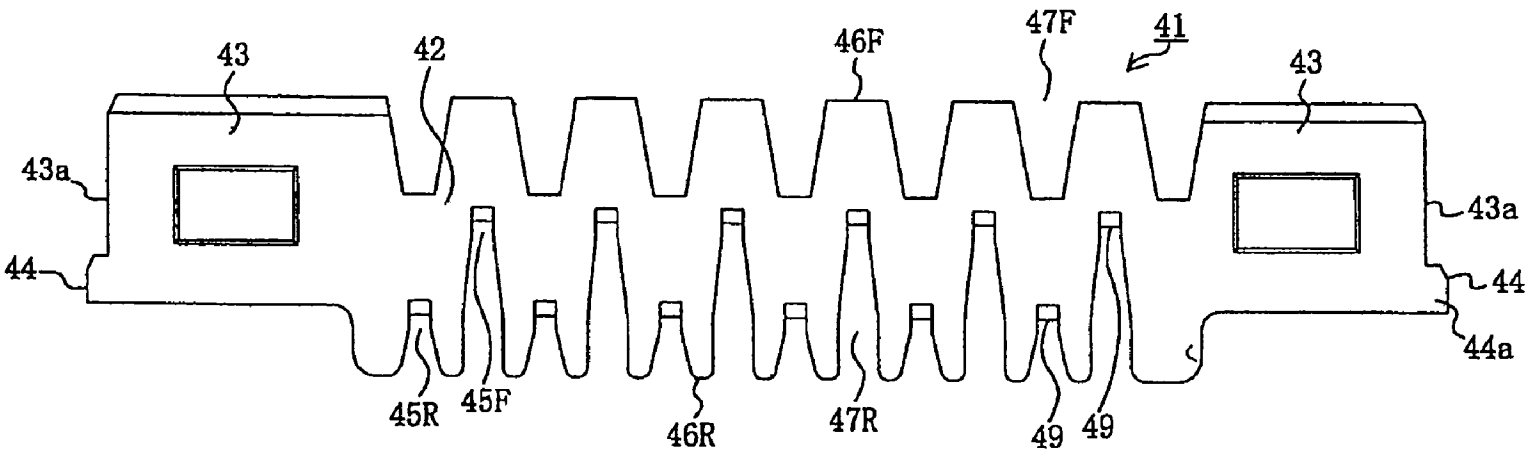
FIG. 6 is a top view of the guide plate, according to the embodiment of the present invention.

FIG. 4 is a perspective view illustrating the rear side of the substrate connector in a state that a shell of the connector is removed, according to the embodiment of the present invention, FIG. 5 is an exploded perspective view of terminals and a guide plate to be attached to the connector according to the embodiment of the present invention, and FIG. 6 is a top view of the guide plate, according to the embodiment of the present invention. It should be noted that FIG. 4B (of FIG. 4) is an enlarged view of a part "A" of FIG. 4A (of FIG. 4).

According to the present embodiment, the terminals 50 may include first terminals 51 and second terminals 52 which are arranged within the upper insertion opening 13*a* and third terminals 53 and fourth terminals 54 which are arranged within the lower insertion opening 13*b*.

The first terminals 51 are provided, respectively, with a main body part, which is elongated in a direction parallel to the substrate, namely, in a direction parallel to the upper extension portion 14*a* to be loaded within the upper terminal receipt holes 16*a*; a first contact portion 51*a* which is connected to the front end of the main body part and contacts an electrode (not illustrated) of the card 101 as a mating terminal; and a first leg or tail portion 51*b* which is connected to the rear end of the main part by an end thereof bent at approximately a right angle and is elongated toward the substrate, namely, downward and of which a lower end is inserted in a through-hole of the substrate. In the same way, the second terminals 52 are provided with a main body part elongated in a direction parallel to the upper extension portion 14*a* to be loaded within the upper terminal receipt hole 16*a*; a second contact portion 52*a* which is connected to a front end of the main body part and contacts an electrode (not illustrated) of the card 101 as a mating terminal; and a second leg or tail portion 52*b* which is connected to the rear end of the main part at an end thereof bent at approximately a right angle and is elongated toward the substrate, namely, downward and of which a lower end is inserted in a through-hole of the substrate.

Additionally, the third terminal 53 is provided with a main body part, which is elongated in a direction parallel to the lower extension portion 14*b* to be loaded within the lower terminal receipt hole 16*b*; a third contact portion 53*a* which is connected to the front end of the main body part and contacts an electrode (not illustrated) of the card 101; and a third leg or tail portion 53*b* which is connected to the rear end of the main part at an end thereof bent at approximately a right angle and is elongated downward and of which a lower end is inserted in a through hole of the substrate. In the same way, the fourth terminal 54 is elongated in a direction parallel to the lower elongated portion 14*b* to be loaded within the lower terminal housing hole 16*b*; a forth contact portion 54*a* which is connected to the front end of the main body part and contacts an electrode (not illustrated) of the card 101; and a fourth leg or tail portion 54*b* which is connected to the rear end of the main body part as being bent at approximately a right angle and is elongated downward and of which a lower end is inserted in a through-hole of the substrate.

As shown in FIG. 4, as being attached to the housing 11, the main body parts of the first terminals 51 and the second terminals 52 are located upward of the main body parts of the third terminals 53 and the fourth terminals 54 and the first leg portions 51*b* and the second leg portions 52*b* of the first terminals 51 and the second terminals 52 are located backward of the third leg portions 53*b* and the fourth leg portions 54*b* of the third terminals 53 and the fourth terminals 54. Therefore, the main body parts of the first terminals 51 and the second terminals 52 are formed to be longer than the main body parts of the third terminal 53 and the fourth terminals 54, and the first leg portions 51*b* and the second leg portions 52*b* of the first terminals 51 and the second terminals 52 are formed to be longer than the third leg portions 53*b* and the fourth leg portions 54*b* of the third terminals 53 and the fourth terminals 54. Further, the first terminals 51 and the second terminals 52 are formed to have the identical shapes and dimensions, and the third terminals 53 and the fourth terminals 54 are formed to have the identical shapes and dimensions.

Additionally, the first terminals 51, the second terminals 52, the third terminals 53, and the fourth terminals 54 will be explained as the terminals 50 when they are generally explained; the first contact portions 51*a*, the second contact portions 52*a*, the third contact portions 53*a*, and the forth contact portions 54*a* will be explained as contact portions 50*a* when they are generally explained; and the first leg portions 51*b*, the second leg portions 52*b*, the third leg portions 53*b*, and the fourth leg portions 54*b* will be explained as leg portions 50*b* when they are generally explained.

The housing 11 is a member in a box shape which is integrally formed including a top board 21, a bottom plate 23, and side plates 22 on the opposite sides of the housing 11 for connecting the top board 21 to the bottom plate 23. When the shell 61 is removed, the surface of the opposite side of the side where the card 101 is inserted, namely, the rear surface is also opened. Therefore, the first terminals 51 and the second terminals 52 are attached to the housing 11 by inserting and loading the main body parts thereof from backward of the housing 11 into the upper terminal receipt holes 16*a*. In addition, the third terminals 53 and the fourth terminals 54 are also attached to the housing 11 by inserting and loading the main body parts thereof from backward of the housing 11 into the lower terminal receipt holes 16*b*.

According to the present embodiment, forward guide plates 24 act as guides for guiding the third leg portions 53*b* and the fourth leg portions 54*b* of the third terminals 53 and the fourth terminals 54 are integrally connected to the rear end of the bottom plate 23 of the housing 11. On the rear surfaces of the forward guide plates 24, a plurality of guide grooves 28, which are respectively shaped in a recessed groove elongated in a forward and rear direction (a vertical direction in FIG. 6) are formed.

The guide grooves 28 may include third guide grooves 28R that are grooves formed relatively shallow, and hold the third leg portions 53*b* further backward and fourth guide grooves 28F that are grooves formed relatively deep, and hold the fourth leg portions 54*b* further forward, and the third guide grooves 28R and the fourth guide grooves 28F may be arranged so as to be alternately juxtaposed. Hence, an interval between one terminal and another terminal, namely, a pitch between the terminals can be reduced.

Alternatively, in the case where the third terminals 53 and the fourth terminals 54 are arranged to be equal in positions in the forward and rear direction, all of the guide grooves 28 of the front guide plate 24 may be formed to have identical depths.

Additionally, in the lower parts of the side plates 22 on the opposite sides of the housing 11, include guide plate attaching portions 25 that are arranged for attaching a backward guide plate 41 that is provided as a guide plate for guiding the first leg portions 51*b* and the second leg portions 52*b* of the first terminals 51 and the second terminals 52. The two guide plate attaching portions 25 are provided with insertion grooves 26 in which the external edges 43*a* of the opposite end portions 43 provided at the right and left ends of the backward guide plate 41 and the locking projections 27 for locking locked portions 44 project outwardly from the end portions 43. Further, each of the guide plate attaching portions 25 is a portion formed so that a portion of the side plate 22 is partially made thick, and the insertion groove 26 and the projection for locking 27 are integrally formed in the guide plate attaching portion 25.

As shown in FIG. 6, the backward guide plate or tail aligner 41 is formed as a long and thin member, and similar to the housing 11, is formed by an insulating material such as a synthetic resin. When viewed from above, a main part 42 of the plate 41 is located on the center position and has a shape where a plurality of S-shaped parts are succeedingly linked together, namely, are formed as a meandering shape. Additionally, each of the end portions 43 integrally connected to the opposite ends of the main part 42 has an approximately rectangular shape, and each of the end portions 43 has the external edge 43*a* to be inserted into the insertion groove 26 of the guide plate attaching portion 25 and the locked portion 44 which projects outward and is engaged with the locking projection 27 of the guide plate attaching portion 25 thereby locking the guide plate in place.

In the front surface (the upper side edge in FIG. 6) of the main part 42, front side convex portions 46F and front side concave portions 47F are formed so as to be alternately disposed. In addition, in the rear surface of the main part 42 (the lower side edge in FIG. 6), rear side convex portions 46R and rear side concave portions 47R are formed so as to be alternately disposed. Then, in the front surface and the rear surface of the main part 42, the front side convex portions 46F and the rear side concave portions 47R are arranged so as to be in registration with each other and the front side concave portions 47F and the rear side convex portions 46R are arranged so as to be in registration with each other. In other words, the rear side concave portions 47R correspond to the front side convex portions 46F, respectively, and the rear side convex portions 46R correspond to the front side concave portions 47F, respectively. Therefore, viewing from above, the main part 42 has a shape where a plurality of S-shaped parts are succeedingly linked, namely, are formed in a meandering shape, so that the main part 42 can have elasticity which is exhibited due to this shape. Then, as shown in FIG. 6, the main part 42 has a linear shape as a whole in an initial state. In other words, a central axis (not illustrated) extending in a left and right horizontal direction is a straight line, however, when an external force is applied to its opposite ends, the central axis is elastically deformed into an arched shape and this allows the main part 42 to have such a shape that the center axis thereof depicts an arc.

With reference to FIGS. 4 and 5, the projections 27 for locking disposed on the opposite sides of the housing 11 project inwardly, and the locked portions 44 of the guide plate 41 disposed on the opposite sides of the end portions 43 project outwardly. Therefore, it will be understood that a downward force acts on the locked portions in FIG. 6. This is because, upon attaching the backward guide plate 41 to the guide plate attaching portions 25, the locked portions 44 come in contact with the locking projections 27. Thus, when the locked portions 44 receives application of a downward force in FIG. 6, the main part 42 has the opposite ends connected to the end portions 43 which are displaced downward in FIG. 6, namely, the rear surface of the main part 42 of the backward guide plate 41 (the lower side edge in FIG. 6) is shrunk, the front surface of the main part 42 (the upper side edge in FIG. 6) is deformed so as to be extended and then, the front surface of the main part 42 is entirely deformed to depict a convex arc shape upward. Hence, the positional relation of the end portions 43 are displaced so that a distance between the locked portions 44 disposed on the opposite sides of the main part 42, is reduced so that the locked portions 44 can be smoothly moved to ride over the locking projection 27, and accordingly, the backward guide plate 41 can be easily attached to the guide plate attaching portion 25.

Additionally, on the rear surface of the main part 42, a plurality of guide grooves 45 shaped, respectively, in a recess groove and elongated in a forward and rear direction (a vertical direction in FIG. 6) is formed. The guide grooves 45 may include first guide grooves 45R that are grooves formed relatively shallow and holds the first leg portions 51*b* at respective further backward portions and second guide grooves 45F that are grooves formed relatively deep and holds the second leg portion 52*b* at respective further forward portions, and the first guide grooves 45R and the second guide grooves 45F may be arranged so as to be alternately disposed. Therefore, an interval between one terminal and another terminal, namely, a pitch between the terminals can be made small.

In the example shown in FIG. 6, each first guide groove 45R is formed in one of the rear convex portions 46R and each second guide groove 45F is formed in one of the rear concave portions 47R. In other words, the first guide grooves 45R and the second guide grooves 45F are arranged so as to be tooth shaped, formed by using a meandering shape.

At this stage, if the first terminals 51 and the second terminals 52 are also arranged so as to occupy identical positions in the forward and rear direction, all of the guide grooves 45 may be formed with the identical depths.

In addition, each of the guide grooves 28 has such a shape that an opening thereof is gradually extended in a direction toward either the front edge or the rear edge of the backward guide plate 41 from each bottom portion 49, namely, is formed to have a tapered shape. Hence, it is possible to smoothly and surely guide a leg portion 50*b* of the terminal 50 into the guide groove 28 and the leg portion 50*b* can be easily mounted therein.

Then, the lower ends of the first leg portions 51*b*, the second leg portions 52*b*, the third leg portions 53*b*, and the fourth leg portions 54*b* are inserted into the through-holes formed in the substrate and are connected by a connecting means such as soldering. In this case, since the first leg portions 51*b*, the second leg portions 52*b*, the third leg portions 53*b*, and the fourth leg portions 54*b* of the terminals 50 are guided and aligned, it is possible to easily carry out the operation for inserting the lower ends of the first leg portions 51*b*, the second leg portions 52*b*, the third leg portions 53*b*, and the fourth leg portions 54*b* into the corresponding through-holes of the substrate. Additionally, it is sure that any short-circuit due to contact of the adjacent the first leg portion 51*b*, the second leg portion 52*b*, the third leg portion 53*b*, and the fourth leg portion 54*b* with each other does not occur.

Next, the operation for attaching the above-mentioned backward guide plate 41 to the housing 11 will be described. Here, it is to be noted that the explanation will be given omitting the shell 61 and the terminal 50 for the convenience sake.

Figure 7:
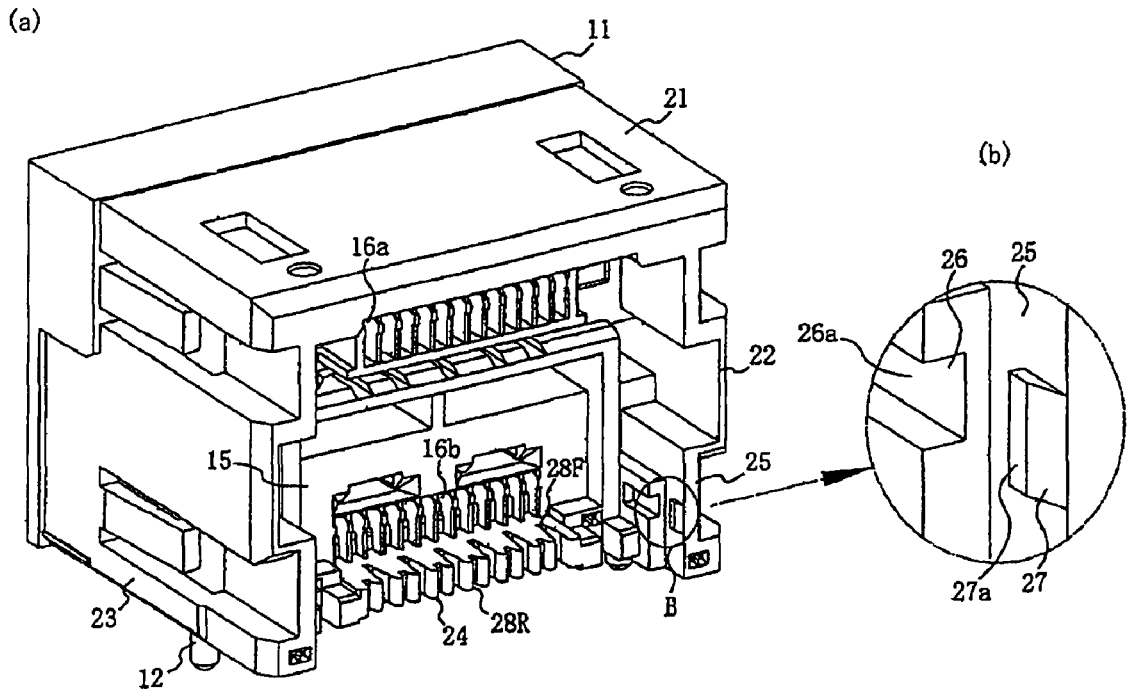
FIG. 7 is a perspective view illustrating the housing where a backside guide plate is not attached, according to the embodiment of the present invention.
Figure 8:
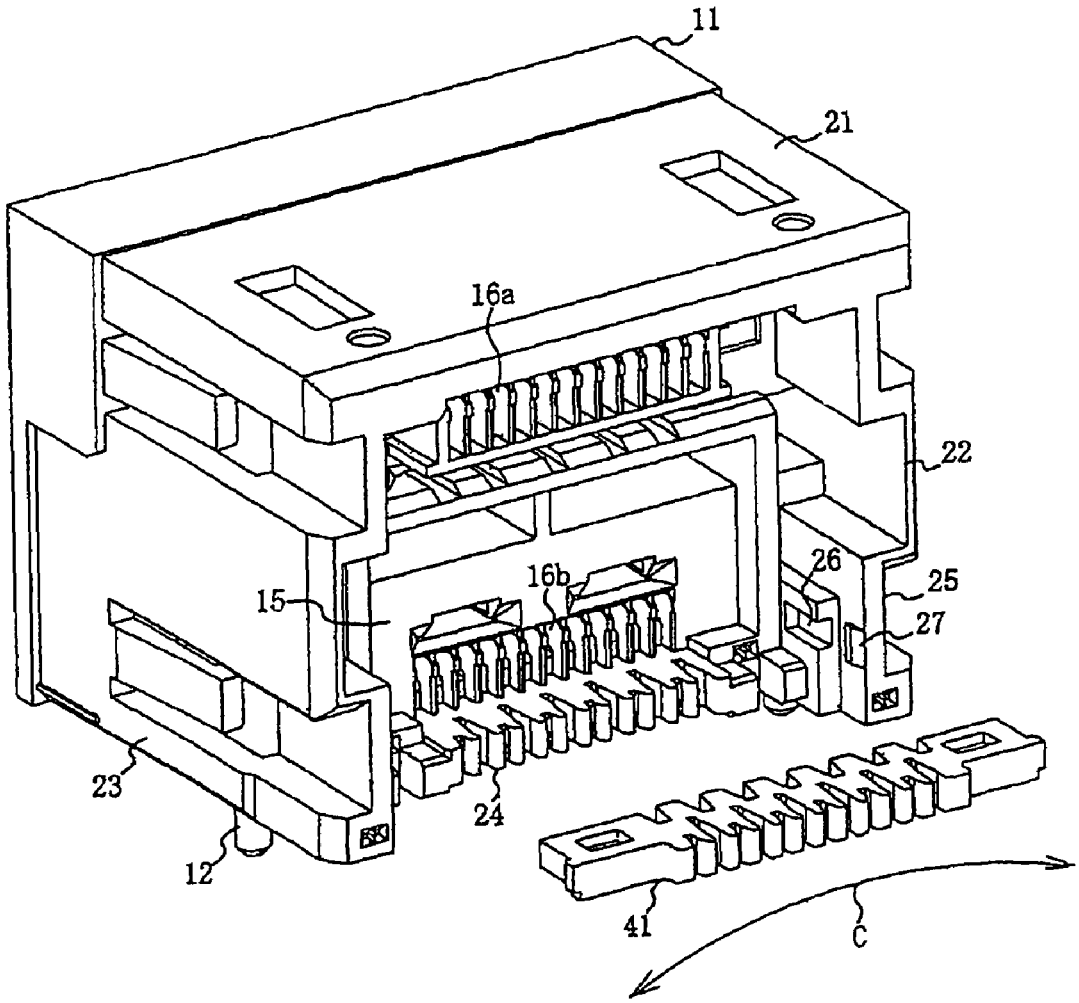
FIG. 8 is a perspective view illustrating the housing at a state immediately before the backside guide plate is attached, according to the embodiment of the present invention.
Figure 9:
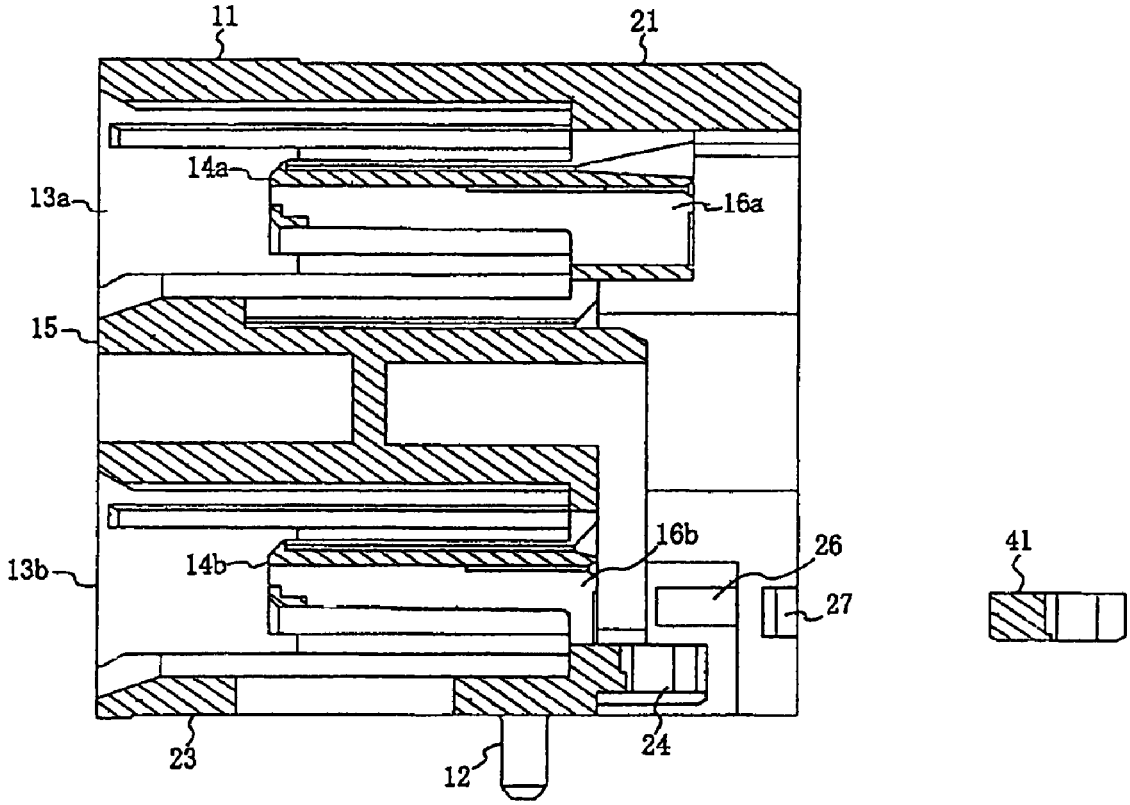
FIG. 9 is a side cross-sectional view illustrating the housing immediately before the backside guide plate is attached, according to the embodiment of the present invention.
Figure 10:
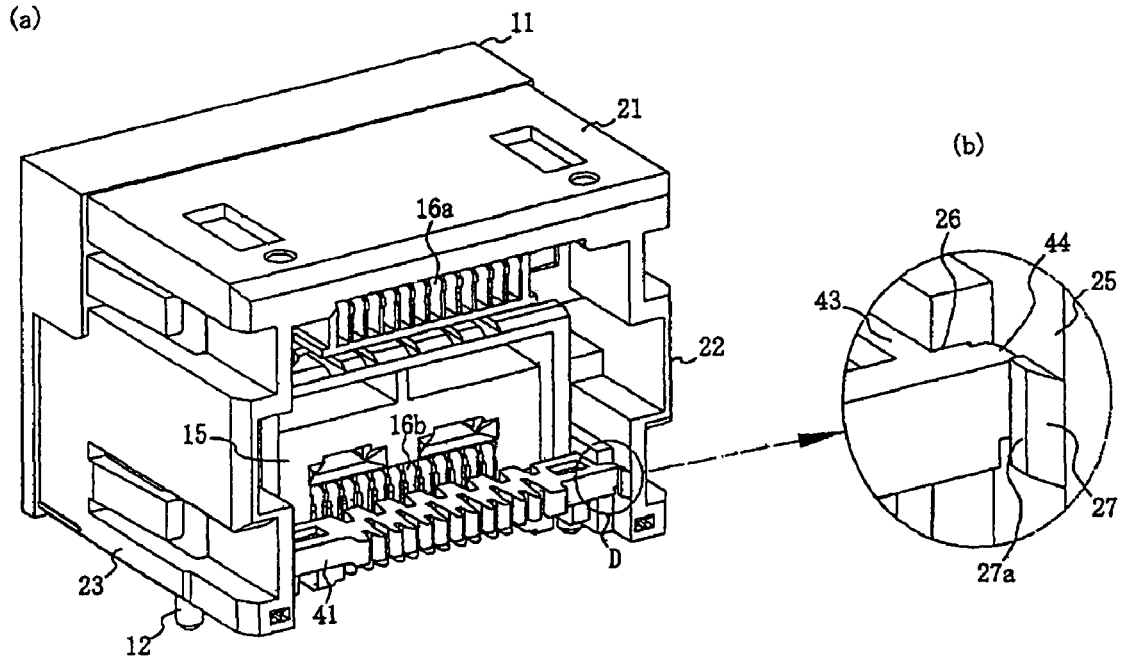
FIG. 10 is a perspective view illustrating the rear side of the housing to which the backside guide plate is attached, according to the embodiment of the present invention.
Figure 11:
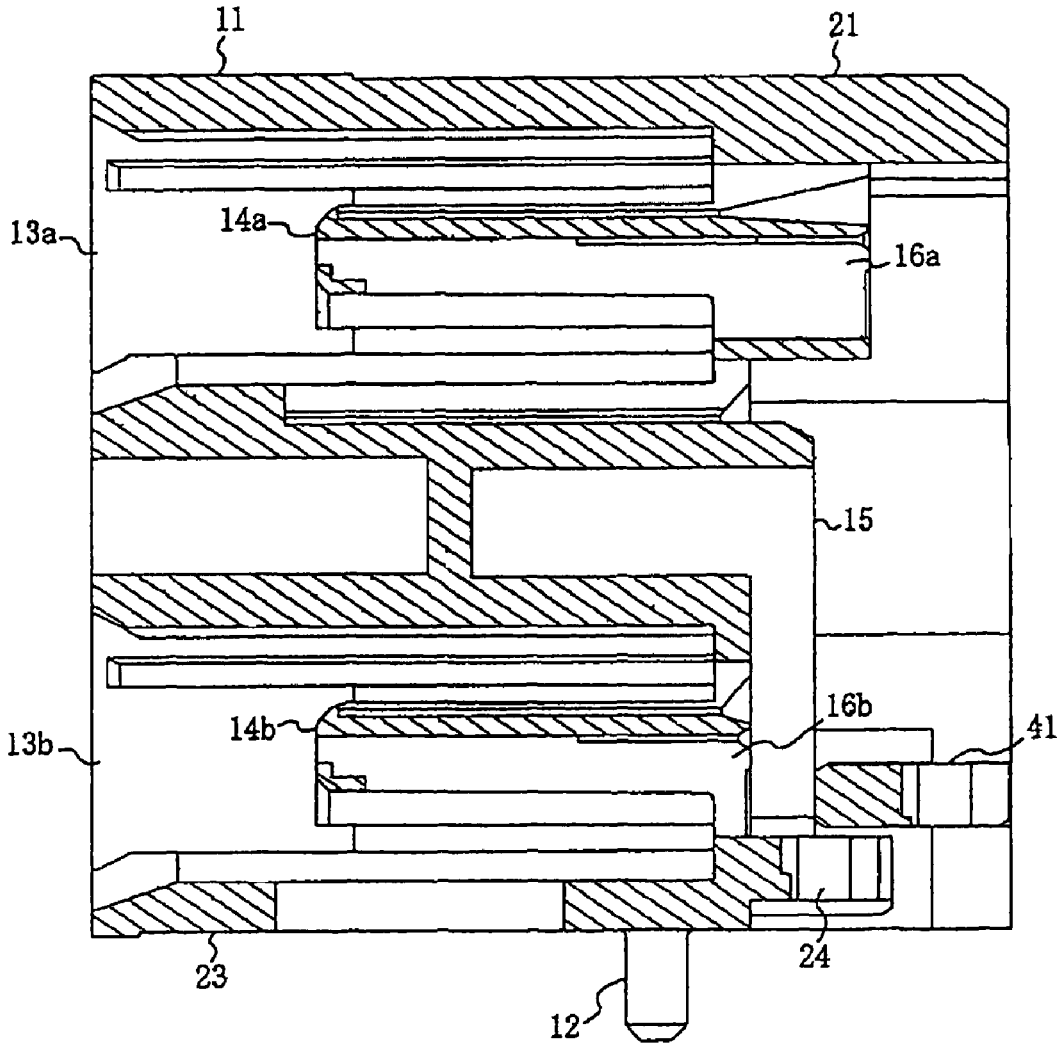
FIG. 11 is a side cross-sectional view illustrating the housing to which the backside guide plate is attached, according to the embodiment of the present invention.

FIG. 7 is a perspective view illustrating the housing where a backside guide plate is not attached, according to the embodiment of the present invention, FIG. 8 is a perspective view illustrating the housing at a state immediately before the backside guide plate is attached, according to the embodiment of the present invention, FIG. 9 is a side cross-sectional view illustrating the housing immediately before the backside guide plate is attached, according to the embodiment of the present invention, FIG. 10 is a perspective view illustrating the rear side of the housing to which the backside guide plate is attached, according to the embodiment of the present invention, and FIG. 11 is a side cross-sectional view illustrating the housing to which the backside guide plate is attached, according to the embodiment of the present invention. Further, FIG. 7B (of FIG. 7) is an enlarged view of "B" part of FIG. 7A (of FIG. 7) and FIG. 10B (of FIG. 10) is an enlarged view illustrating "D" part of FIG. 10A (of FIG. 10).

As shown in FIG. 7, when the backward guide plate 41 is not attached, the insertion grooves 26 and the locking projections 27 formed in the guide plate attaching portions 25 on the opposite sides of the housing 11 are exposed on the inside of the lower part of the side plate 22. The dimension in a vertical direction of each insertion groove 26 corresponds to the dimension of thickness of each external edge 43*a* on respective one of the end portions 43 of the backward guide plate 41 to be inserted into the insertion groove 26 and the distance between the bottom surfaces 26*a* (the right side surface in FIG. 7B) of the insertion grooves 26 on the opposite sides is determined so as to correspond to the distance between the external edges 43*a* on the opposite sides. Additionally, the distance between top portions 27*a* of the locking projections 27 on the opposite sides is determined so as to be shorter than the distance between top portions 44*a* of the locked portions 44 on the end portions 43 on the opposite sides of the backward guide plate 41.

As shown in FIGS. 8 and 9, the backward guide plate 41 is moved forward from backward of the housing 11 toward the housing 11 and the end portions 43 on the opposite sides of the backward guide plate 41 are attached to the guide plate attaching portions 25 on the opposite sides. In this case, the external edges 43*a* of the end portions 43 are inserted in the insertion grooves 26, the locked portions 44 are moved so that the top portions 44*a* thereof ride over the top portions 27*a* of the locking projections 27, and then, the top portions 44*a* are fitted between the insertion grooves 26 and the locking projections 27 so as to be locked in place.

However, it should be understood that prior to a state where the backward guide plate 41 is attached to the housing 11, namely, in the initial state of the backward guide plate 41, the main part 42 has entirely a linearly straight shape. However, the locked portions 44 thereof receive a force due to contacting of the locked portions 44 with the locking projections 27 when the backward guide plate 41 is attached to the guide plate attaching portions 25, and therefore, the main part 42 is entirely deformed into an arched shape and this allows the main part 42 to have an arc shape as shown in an arrow "C" in FIG. 8.

Hence, the distance between the locked portions 44 on the opposite sides of the backward guide plate 41 is shortened, the top portions 44*a* of the locked portions 44 can smoothly be moved to ride over the top portions 27*a* of the locking projections 27 and the backward guide plate 41 can be easily seated in the guide plate attaching portions 25. Additionally, a force generated when the locked portions 44 come into contact with the locking projections 27 is absorbed by the elastic deformation of the main part 42, and as a result, the end portions 43 including the locked portions 44 and the guide plate attaching portions 25 including the locking projections 27 are neither worn nor damaged.

As shown in FIGS. 10 and 11, the backward guide plate 41 is attached to and seated in the guide plate attaching portions 25 of the housing 11. Further, when the distance between the external edges 43*a* on the opposite sides of the backward guide plate 41 are preliminarily determined so as to be slightly longer than the distance between the bottom surfaces 26*a* of the insertion grooves 26 on the opposite sides of the housing 11, even in the state of being attached to the guide plate attaching portion 25, the backward guide plate 41 receives a force in a longitudinal direction, namely, a force by which it is compressed in a direction of a width of the housing 11 by the guide plate attaching portions 25 on the opposite sides of the housing 11. Hence, the end portions 43 on the opposite sides of the main part 42 are pressed against the guide plate attaching portions 25. Therefore, the backward guide plate 41 is kept in a state to be attached to the housing 11 without any play. Additionally, since the locked portions 44 are in a state to be compressed between the insertion grooves 26 and the locking projections 27, the engagement state between the locked portions 44 and the locking projections 27 can be made sure and kept stable, so that the engagement cannot be released. Accordingly, the backward guide plate 41 is surely and reliably locked, so that the backward guide plate 41 is not separated apart from the housing 11.

Next, the positional relationship between the backward guide plate 41, the third terminals 53, and the fourth terminals 54 will be described. Here, it is to be noted that the description will be provided while omitting the shell 61, the first terminals 51, and the second terminals 52 for the convenience sake.

Figure 12:
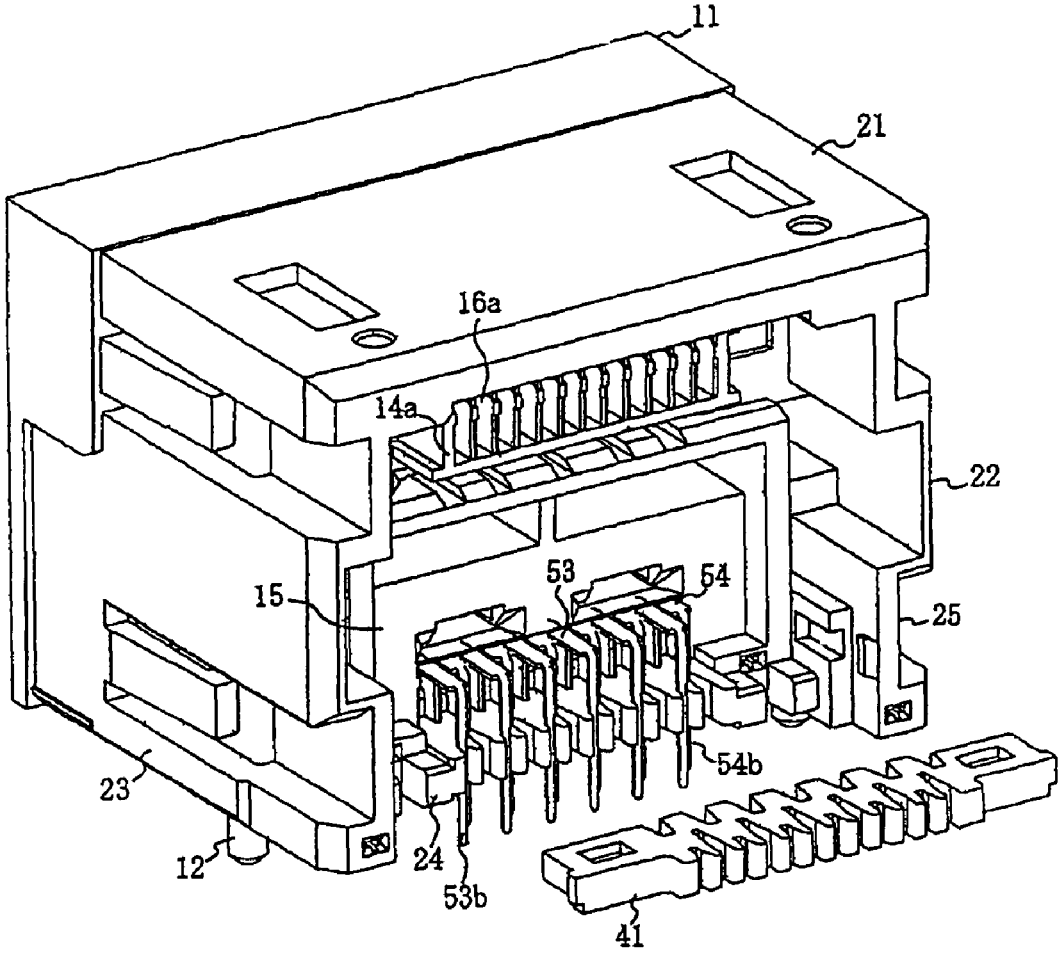
FIG. 12 is a perspective view illustrating the rear side of the housing provided with third terminals and fourth terminals immediately before the backside guide plate is attached, according to the embodiment of the present invention.
Figure 13:
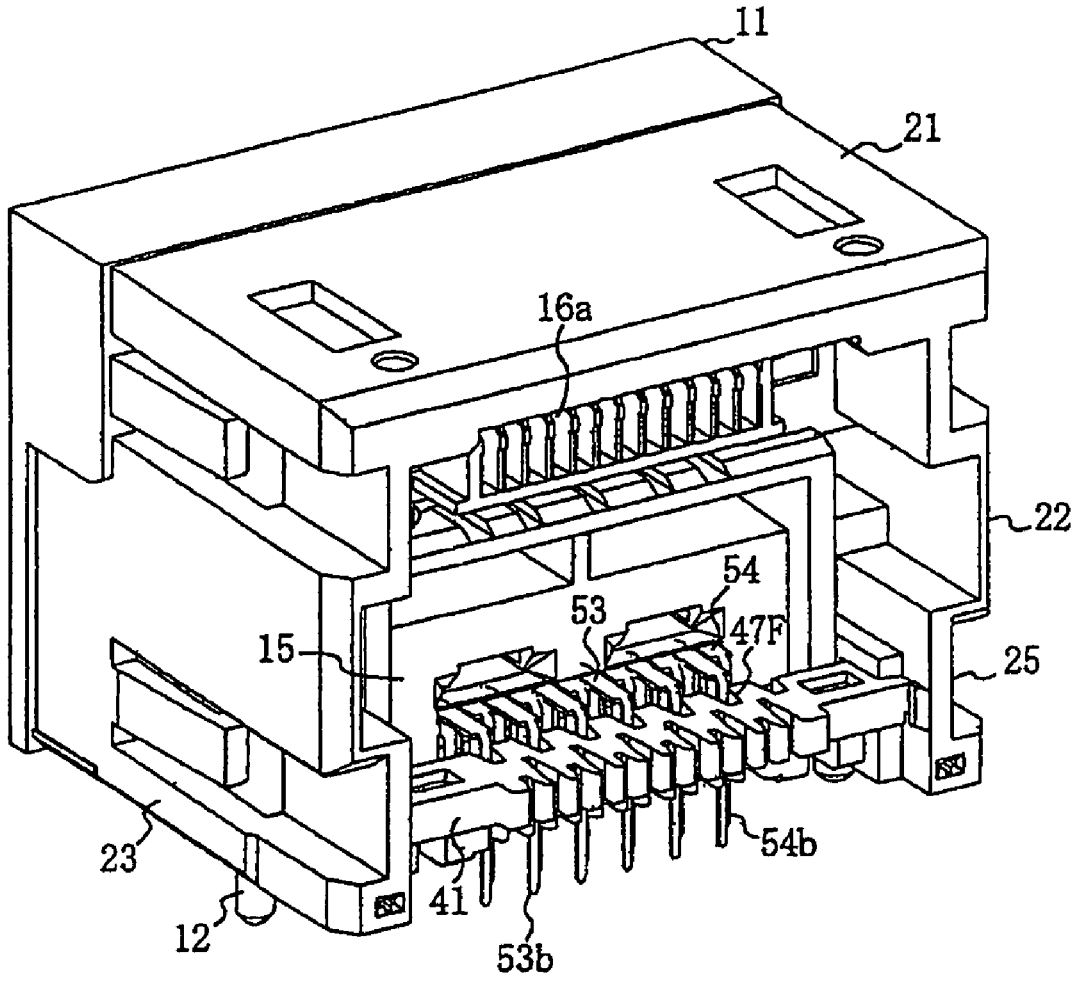
FIG. 13 is a perspective view illustrating the rear side of the housing provided with the third terminals and the fourth terminals where the backside guide plate is attached, according to the embodiment of the present invention.

FIG. 12 is a perspective view illustrating the rear side of the housing provided with third terminals and fourth terminals immediately before the backside guide plate is attached, according to the embodiment of the present invention, and FIG. 13 is a perspective view illustrating the rear side of the housing provided with the third terminals and the fourth terminals where the backside guide plate is attached, according to the embodiment of the present invention.

As shown in FIG. 12, the third leg portions 53*b* and the fourth leg portions 54*b* of the third terminals 53 and the fourth terminals 54 attached to the housing 11 are held within and guided by the third guide grooves 28R and the fourth guide grooves 28F of the forward guide plate 24. In this case, the third leg portions 53*b* and the fourth leg portions 54*b* are tooth shaped and formed in a width direction of the connector 1 and to be located backward of the third leg portions 53*b*. Incidentally, as shown in FIGS. 10 and 11, the backward guide plate 41 is located in the vicinity of the forward guide plate 24 in the state where the former is attached to the housing 11, and therefore, there is a possibility that the backward guide plate 41, in particular, may interfere with the third leg portions 53*b* of the third terminals 53 arranged so as to be located backward.

Taking this into consideration, according to the present embodiment, the position and the size of the front side concave portions 47F that are formed in the front surface of the main part 42 of the backward guide plate 41 are formed to be in registration with the third leg portions 53*b* of the third terminals 53. In other words, the position and the size of the front side concave portions 47F are determined so that each of the third leg portions 53*b* of the third terminals 53 can be fitted in each of the front side concave portions 47F. Therefore, as shown in FIG. 13, with the backward guide plate 41 attached to the housing 11, each of the third leg portions 53*b* enters each of the front side concave portions 47F, so that the third leg portions 53*b* do not interfere with the backward guide plate 41.

Further, in the case where the backward guide plate 41 does not come close to the forward guide plate 24, namely, where the backward guide plate 41 is attached to the housing 11 so as to be separated apart from the forward guide plate 24 in the front and rear direction of the housing 11, there is no possibility that the third leg portions 53*b* interfere with the backward guide plate 41. As a result, there is no necessity to specify the position and the size of the front side concave portions 47F to the third leg portions 53*b*.

Next, a positional relationship between the backward guide plate 41, the first terminals 51, and the second terminals 52 will be described. Here, it is to be noted that the explanation will be provided omitting the shell 61, the third terminals 53, and the fourth terminals 54 for the convenience sake.

Figure 14:
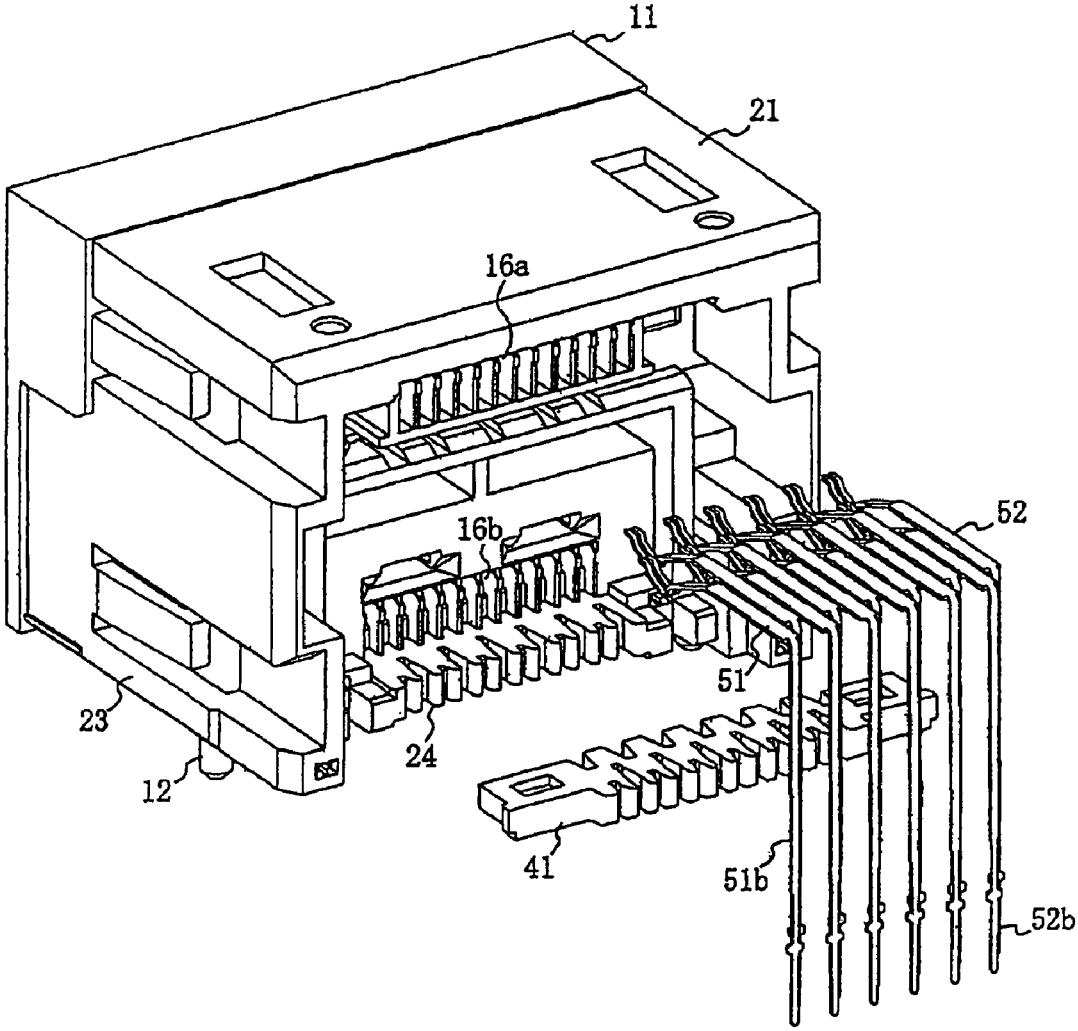
FIG. 14 is a perspective view illustrating the rear side of the housing immediately before the backside guide plate and first terminals and second terminals are attached, according to the embodiment of the present invention.
Figure 15:
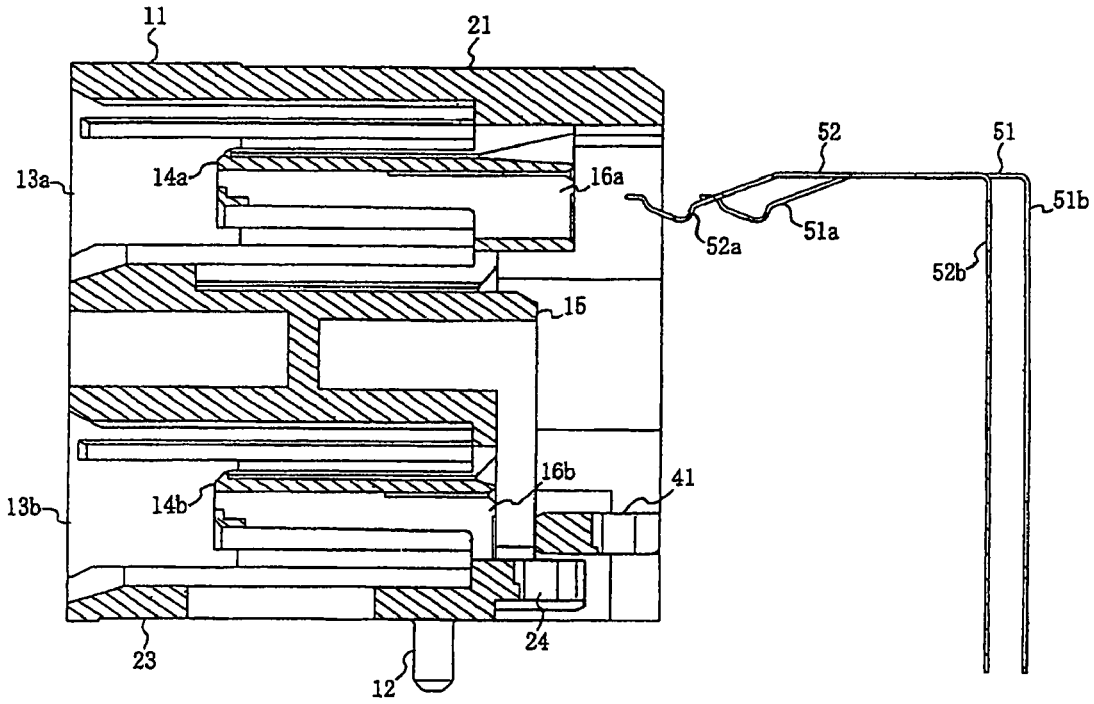
FIG. 15 is a side cross-sectional view illustrating the housing immediately before the first terminals and the second terminals are attached, according to the embodiment of the present invention.
Figure 16:
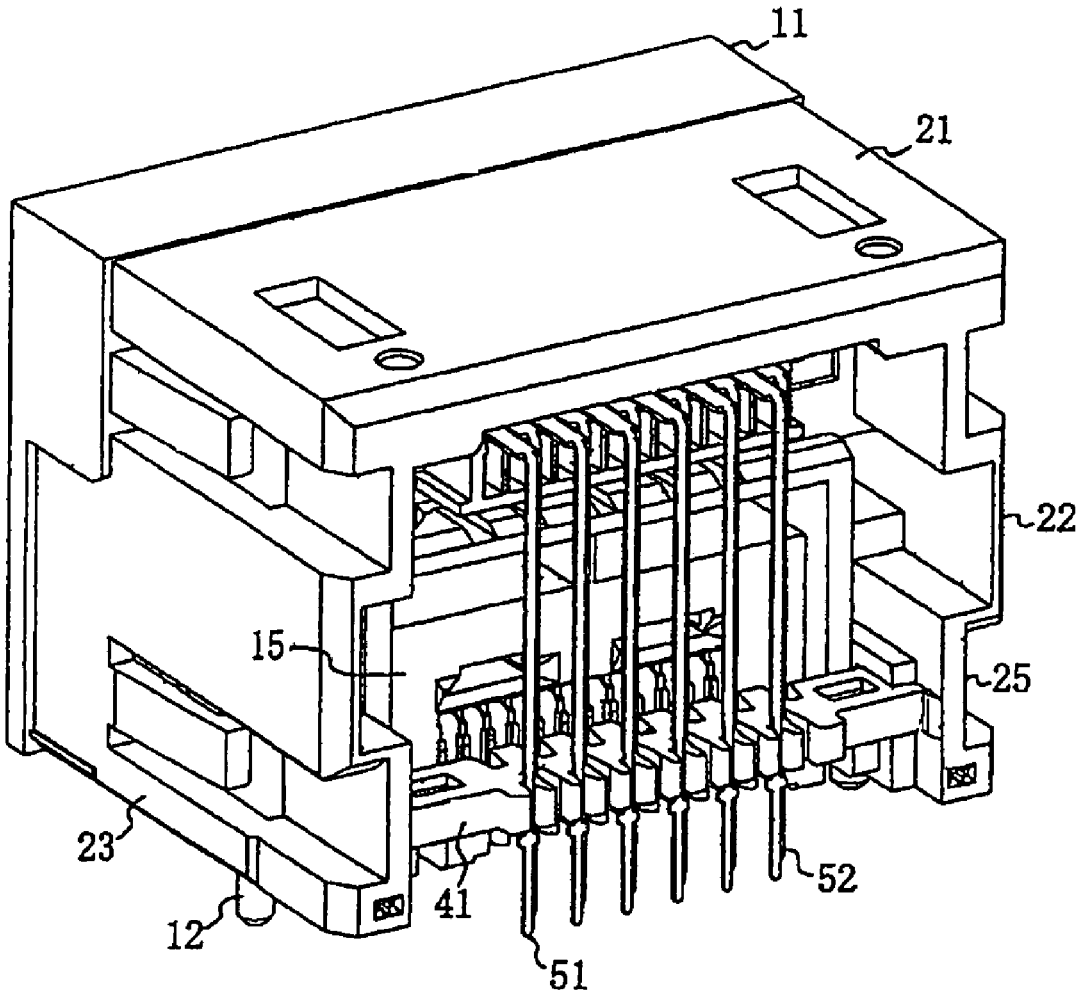
FIG. 16 is a perspective view illustrating the rear side of the housing to which the backside guide plate and the first terminals and the second terminals are attached, according to the embodiment of the present invention.
Figure 17:
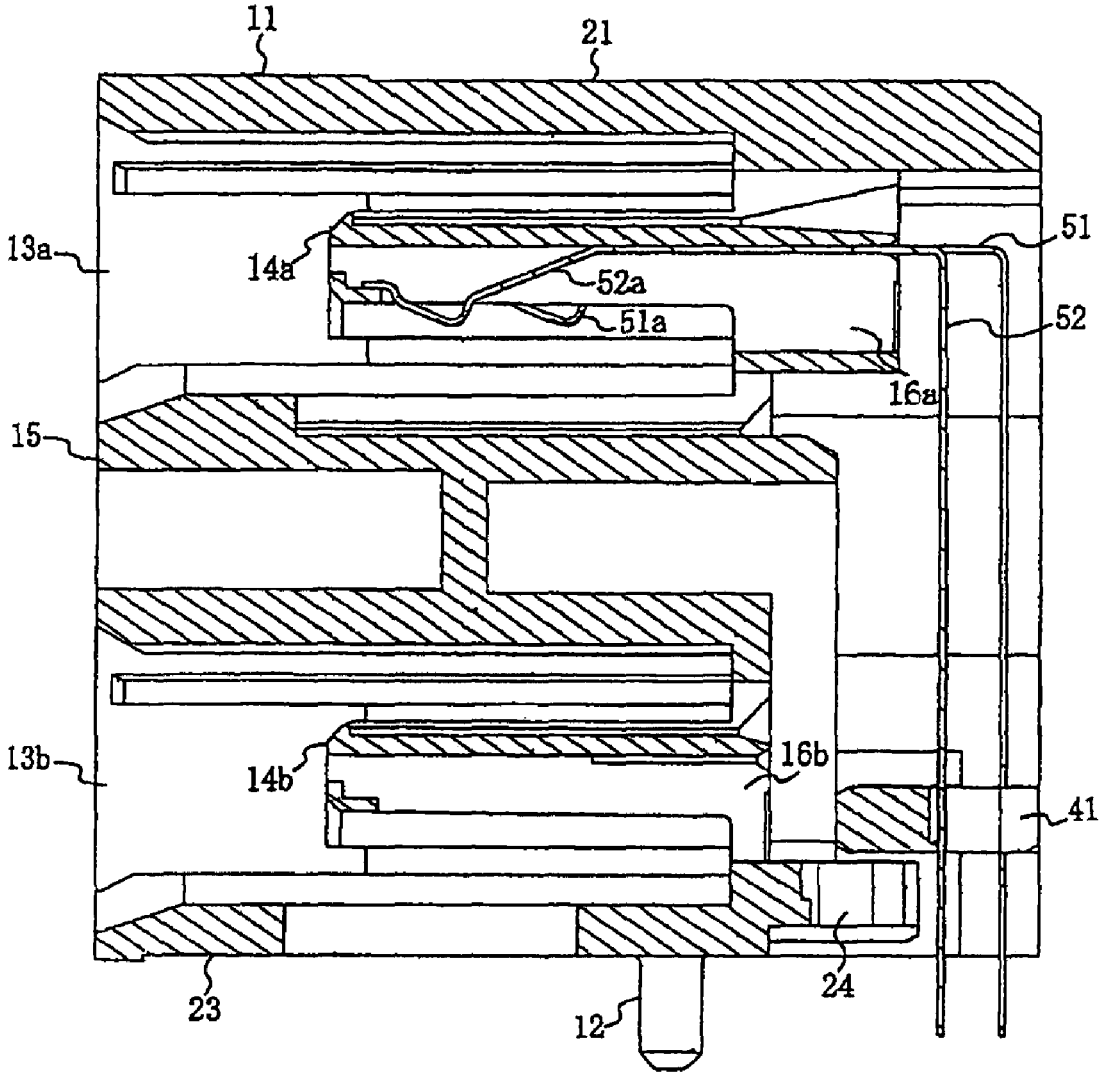
FIG. 17 is a side cross-sectional view illustrating the housing to which the backside guide plate and the first terminals and the second terminals are attached, according to the embodiment of the present invention.
Figure 18:
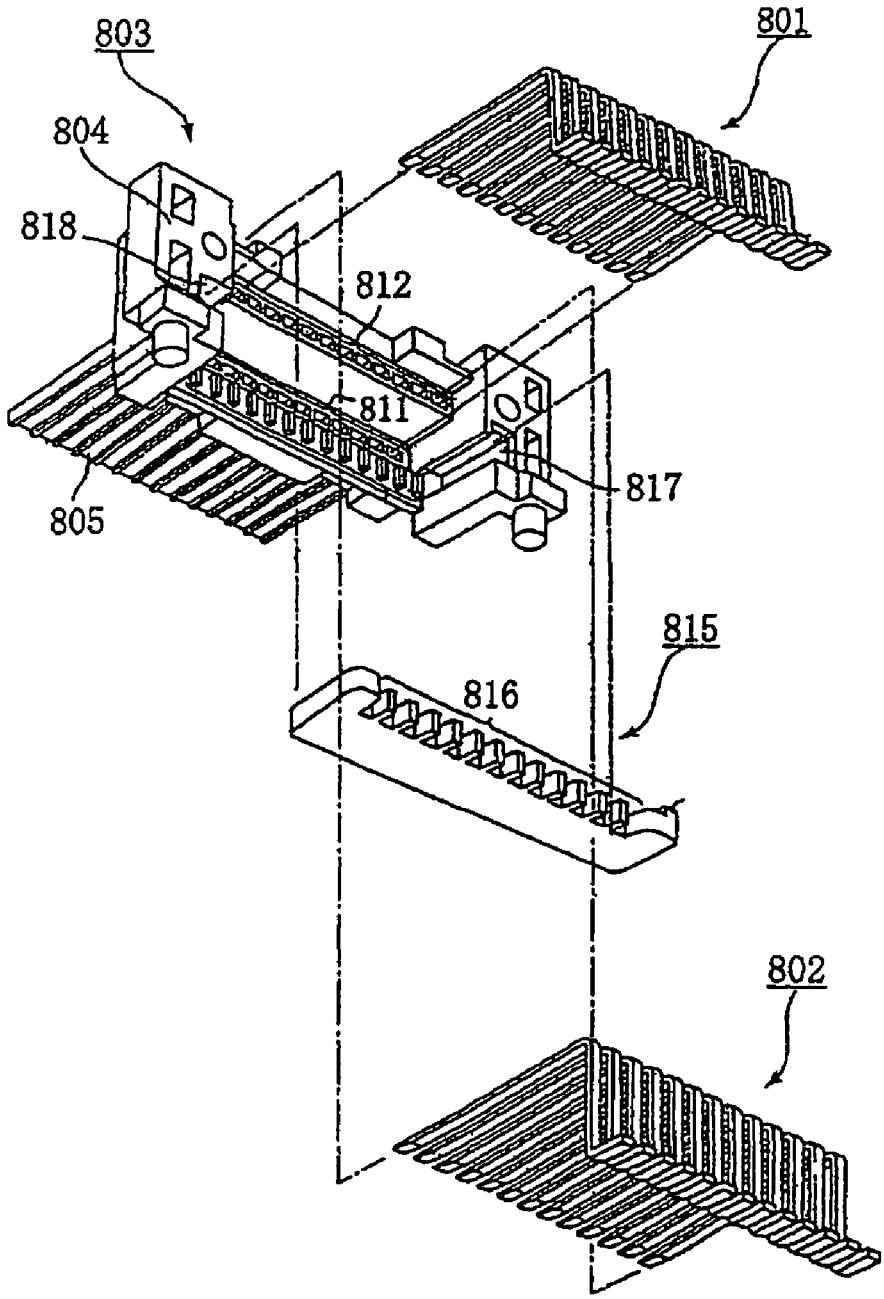
(Prior art) FIG. 18
FIG. 18 is an exploded view of a conventional substrate connector.

FIG. 14 is a perspective view illustrating the rear side of the housing immediately before the backside guide plate and first terminals and second terminals are attached, according to the embodiment of the present invention, FIG. 15 is a side cross-sectional view illustrating the housing immediately before the first terminals and the second terminals are attached, according to the embodiment of the present invention, FIG. 16 is a perspective view illustrating the rear side of the housing to which the backside guide plate and the first terminals and the second terminals are attached, according to the embodiment of the present invention, and FIG. 17 is a side cross-sectional view illustrating the housing to which the backside guide plate and the first terminals and the second terminals are attached, according to the embodiment of the present invention.

As shown in FIG. 14, the backward guide plate 41 is moved forward from backward of the housing 11 toward the housing 11 and the end portions 43 on the opposite sides of the backward guide plate 41 are attached to the guide plate attaching portions 25 on the opposite sides. In this case, the external edges 43*a* of the end portions 43 are inserted into the insertion grooves 26, and the locked portions 44 having the top portions 44*a* (refer to FIG. 6) are moved to ride over the top portions 27*a* of the locking projections 27, and then, the top portions 44*a* are fitted between the insertion grooves 26 and the locking projections 27 so as to be locked in place. Therefore, as shown in FIG. 15, the backward guide plate 41 is attached to the guide plate attaching portions 25 of the housing 11.

Next, the first terminals 51 and the second terminals 52 are moved from backward of the housing 11 toward inside of the housing 11 and they are attached to the housing 11 by inserting and loading the main body parts of the first terminals 51 and the second terminals 52 into the upper terminal receipt holes 16*a*. Additionally, the first leg portions 51*b* and the second leg portions 52*b* of the first terminals 51 and the second terminals 52 are inserted and held into the first guide grooves 45R and the second guide grooves 45F of the backward guide plate 41. As described above, the first guide grooves 45R and the second guide grooves 45F are arranged so as to be tooth shaped and formed in a width direction of the connector 1, so that the positions of the first guide grooves 45R and the second guide grooves 45F are fitted to the positions of the first leg portions 51*b* and the second leg portions 52*b* also arranged so as to be tooth shaped and formed in a width direction of the connector 1. Therefore, as shown in FIGS. 16 and 17, the first leg portions 51*b* and the second leg portions 52*b* of the first terminals 51 and the second terminals 52 are held and guided by the first guide grooves 45R and the second guide grooves 45F of the backward guide plate 41.

Consequently, in a state where the first terminals 51 and the second terminals 52 are attached to the housing 11, the angles between the main body parts of the first terminals 51 and the second terminals 52 and first leg portions 51*b* and the second leg portions 52*b* are approximately 90 degrees as shown in FIG. 17. However, in the initial state, namely, in the state before the first terminals 51 and the second terminals 52 are attached to the housing 11, it is preferable that the angles between the main body parts and the first leg portions 51*b* and the second leg portions 52*b* are determined so as to be at a smaller angle, namely, at an acute angle. By determining the angles to be such a smaller angle, when the first terminals 51 and the second terminals 52 are attached to the housing 11, the first terminals 51 and the second terminals 52 are elastically deformed, so that the angles between the main body parts and the first leg portions 51*b* and the second leg portions 52*b* have been expanded by the backward guide plate 41. Then, an urging force acting as a spring force is generated, the first leg portions 51*b* and the second leg portions 52*b* are pressed against the first guide grooves 45R and the second guide grooves 45F of the backward guide plate 41 by that urging force, and then, they are elastically deformed so as to make approximately 90 degrees. Therefore, the first leg portions 51*b* and the second leg portions 52*b* are kept in a state where these leg portions 51*b* and 52 bare attached to the backward guide plate 41 without occurrence of any play.

Moreover, the first leg portions 51*b* and the second leg portions 52*b* are in the state of being always pressed against the bottom portions 49 of the first guide grooves 45R and the second guide grooves 45F by a slight force, so that the positions of the first leg portions 51*b* and the second leg portions 52*b* are held in the positions of the bottom portions 49 of the first guide grooves 45R and the second guide grooves 45F of the backward guide plate 41. Therefore, owing to the positions of the bottom portions 49 of the first guide grooves 45R and the second guide grooves 45F of the backward guide plate 41, the first leg portions 51*b* and the second leg portions 52*b* can be accurately set in position, so that it is possible to easily mount the connector 1 on the accurate position in the through-hole of the substrate.

Desirably, desirably, the third terminals 53 and the fourth terminals 54 are also determined so that the angles between the main body parts and the third leg portions 53*b* and the fourth leg portions 54*b* define an acute angle in an initial state of both terminals 53 and 54 similarly to the case of the afore-mentioned first and second terminals. Hence, the third leg portions 53*b* and the fourth leg portions 54*b* are in the state of being attached to the forward guide plate 24 without any play.

Additionally, the angle between each of the main body parts and each of the leg portions 50*b* in the initial state is not limited to the acute angle and if the position of the bottom portions 49 of the guide grooves 45 is formed to be backward (a right direction in FIG. 17) of the position of the leg portions 50*b* when the terminals 50 are mounted in the housing 11 in the state that the backward guide plate 41 is not mounted in the housing 11, the state that the leg portions 50*b* are pressed against the guide grooves 45 can be obtained.

Thus, according to the present embodiment, the backward guide plate 41 is provided with the main part 42 formed in a meandering shape and the end portions 43 which are connected to the opposite sides of the main part 42 and attached to the guide plate attaching portions 25 which are arranged on the opposite sides of the housing 11. Therefore, since the main part 42 of the backward guide plate 41 has a meandering shape, the positional relationship between the end portions 43 on the opposite sides of the backward guide plate 41 can be elastically displaced. As a result, when mounting the backward guide plate 41 on the housing 11, the end portions 43 of the backward guide plate 41 can be easily attached to the guide plate attaching portions 25 on the opposite sides of the housing 11.

Additionally, each of the guide plate attaching portions 25 is provided with the insertion groove 26 and the locking projection 27, and the end portions 43 of the backward guide plate 41 are provided with the external edges 43*a* to be inserted into the insertion grooves 26 and the locked portions 44 which outwardly project from the end portions 43 to be locked by the locking projections 27. Therefore, when mounting the backward guide plate 41, it is possible to easily insert the external edges 43*a* of the backward guide plate 41 into the insertion grooves 26. Consequently, the locked portions 44 or the locking projections 27 are not damaged.

According to the present embodiment, only a description of the case that the forward guide plate 24 is integrally joined to the housing 11 has been described hereinbefore, however, the forward guide plate 24 may be a member which is formed separately from the housing 11 and is attached to the housing 11 as well as the backward guide plate 41.

The present invention is not limited to the above-described embodiments, and may be changed in various ways based on the gist of the present invention, and these changes are not eliminated from the scope of the present invention.

What is claimed is:

1. A connector, comprising:

a housing;

a plurality of terminals supported by the housing each terminal including a contact portion and a tail portion, and a guide plate for guiding the tail portions terminal in place with said housing, wherein the guide plate includes a main part formed in a meandering shape, with end portions at opposite sides of said main part and is held between sidewalls of opposite sides of said housing; and wherein, the guide plate is elastically deformed when compressed upon being joined to the housing, therefore minimizing damage to the guide plate attaching portions on the housing.

2. The connector according to claim 1, wherein the main part of the guide plate includes front side projection portions and front side recess portions alternately aligned on a front face of the main part, and rear side projection portions and rear side recess portions alternately aligned on a rear face of the main part; and the front side projection portions and the rear side recess portions are aligned with each other and the front side recess portions and the rear side projection portions are aligned with each other.

3. The connector according to claim 1, wherein each of the terminals comprises a main part which is mounted on the housing, the contact portions thereof are connected to front ends of the main parts and tail portions are joined to rear ends of said main parts at a bent portion thereof, the lower ends thereof for connecting to a substrate; and the guide plate has guide grooves for holding the tail portions of at least some of the terminals, respectively.

4. The connector according to claim 3, wherein each of said guide grooves has a bottom portion which holds one of said terminals, and prior to attaching the guide plate to the housing, the position of said bottom portion is located rearward of said tail portion.

5. The connector according to claim 3, wherein said terminal includes juxtaposed first terminals and second terminals where the tail portions follow along said meandering shape, and said guide grooves of said guide plate include first guide grooves for guiding first tail portions of the first terminals and second guide grooves for guiding second tail portions of the second terminals.

6. The connector according to claim 1, wherein said sidewalls of the housing has an insertion groove and a projection for locking; and each of the ends of the guide plate includes a locking portion projecting from said ends outward from the end and engaging said projection.

7. The connector according to claim 6, wherein a top portion of said locking portion is deflected by said projection upon attachment of the guide plate.

8. The connector according to claim 6, wherein the width of the guide plate is greater than the distance between said insertion grooves on the sidewalls of said housing.

* * * * *